US006672720B2

(12) United States Patent
Smith

(10) Patent No.: US 6,672,720 B2
(45) Date of Patent: Jan. 6, 2004

(54) PRINTER WITH VACUUM PLATEN HAVING MOVABLE BELT PROVIDING SELECTABLE ACTIVE AREA

(75) Inventor: David E. Smith, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 585 days.

(21) Appl. No.: 09/728,299

(22) Filed: Dec. 1, 2000

(65) Prior Publication Data

US 2002/0067403 A1 Jun. 6, 2002

(51) Int. Cl.[7] ..... B41J 2/01

(52) U.S. Cl. ..... 347/104; 347/101; 347/102; 271/197

(58) Field of Search ..... 347/104, 101, 347/102, 1; 399/361; 400/578; 271/197

(56) References Cited

U.S. PATENT DOCUMENTS 3,527,166 A * 9/1970 Jaffa et al.
3,754,751 A * 8/1973 Capetti et al.
4,819,928 A * 4/1989 Osborn et al.
6,315,404 B1 11/2001 Wotton et al.

FOREIGN PATENT DOCUMENTS

GB 2354975 4/2001
GB 2359520 8/2001

* cited by examiner

*Primary Examiner*—Stephen D. Meier
*Assistant Examiner*—Manish Shah

(57) ABSTRACT

A printer having a media transport with a rigid, air-transmissive platen. A movable air-transmissive flexible web overlays the platen, and a suction device communicates with the platen to draw air through the web and through the platen, such that a sheet of media carried on the web is biased toward the platen. A second movable web below the first web limits air flow through at least a selected portion of the platen other than a portion overlaid by the sheet. The movable web may be a continuous belt, which may have two separate air-blocking regions that are positioned beyond the platen when full airflow is desired, and at least partly registered with the platen to block airflow to peripheral platen portions.

20 Claims, 3 Drawing Sheets

PRINTER WITH VACUUM PLATEN HAVING MOVABLE BELT PROVIDING SELECTABLE ACTIVE AREA

FIELD OF THE INVENTION

This invention relates to computer printers, and particularly to media transports mechanisms and vacuum hold-down devices.

BACKGROUND AND SUMMARY OF THE INVENTION

Some approaches for thermal inkjet printing use a vacuum platen as part of the media transport. Essentially, a sheet of media to be printed is carried on an air-transmissive belt over a flat plate that contains a multitude of apertures. A vacuum device below the plate draws air into the apertures, creating a pressure differential that flattens the media sheet against the plate, with the web sliding over the plate to feed the sheet past a printing device. The printing device may be a thermal ink jet pen that reciprocates over the sheet in a scan direction perpendicular to the feed direction, and which lays down successive swaths of ink droplets to generate a printed image.

The platen is normally heated to facilitate rapid drying of aqueous ink, and the vacuum effect holds the sheet in a flat stable position as the ink dries. This avoids curling or "cockle" effects that can distort the media surface in areas where large quantities of ink are imprinted, due to the dimensional effect of moisture on paper and other media. When the media is held flat during the drying process, a flat result is generated.

While effective for many applications, vacuum platens have certain limitations. First, smaller media that does not cover most of the platen area leave substantial platen areas open. This permits air to be drawn into the area below the platen, bypassing the sheet, and thereby requiring substantial airflow capacity to maintain adequate relative pressure on the sheet. For a minimally sized sheet, nearly the entire area of the platen may be open to airflow. This requires a large vacuum blower, with attendant problems of size, power consumption, and noise. Further, for the platen to be maintained at an elevated temperature needed for ink drying, increased heating power is needed to offset the cooling effect of ambient air flowing through the platen. Also, open areas surrounding a small media sheet may still have depressed temperatures compared to covered regions, and subsequent large media may encounter non-uniform platen temperatures that may impair printing results.

An additional concern even for platens optimized for a particular media width is that unless a continuous end-to-end stream of media is passed over the platen, there will be large open areas of the platen ahead of the leading edge of the first sheet, and following the training edge of the last sheet. This generates similar disadvantages to those discussed above regarding media width.

The present invention overcomes the limitations of the prior art by providing a printer having a media transport with a rigid, air-transmissive platen. A movable air-transmissive flexible web overlays the platen, and a suction device communicates with the platen to draw air through the web and through the platen, such that a sheet of media carried on the web is biased toward the platen. A second movable web below the first web limits air flow through at least a selected portion of the platen other than a portion overlaid by the sheet. The movable web may be a continuous belt, which may have two separate air-blocking regions that are positioned beyond the platen when full airflow is desired, and at least partly registered with the platen to block airflow to peripheral platen portions.

Figure 1:
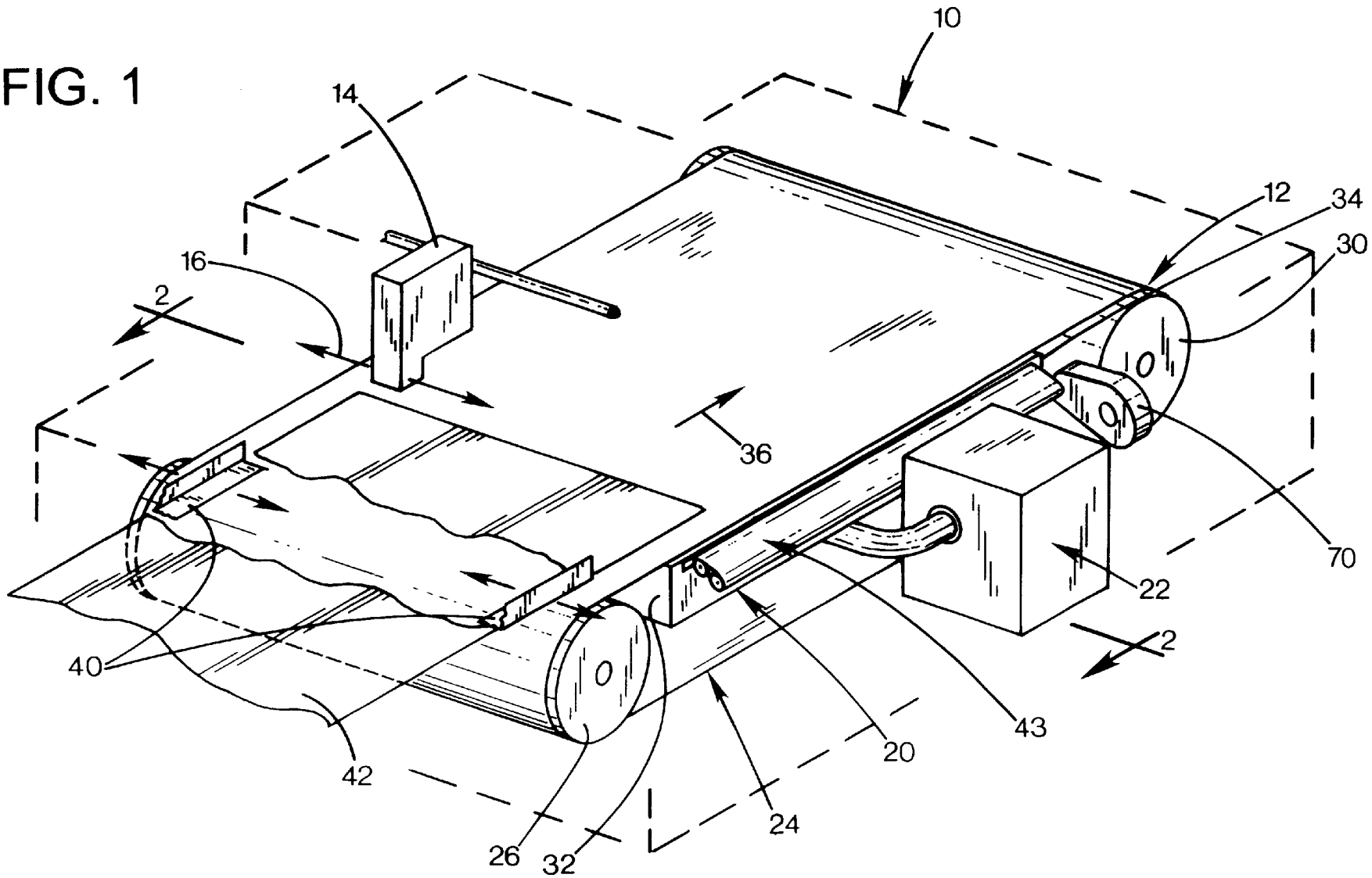
FIG. 1 is a perspective view of a printer and media transport mechanism according to a preferred embodiment of the invention.

FIGS. *3a–3d* are simplified sectional end views of the media transport mechanism of FIG. 1 at various conditions of operation.

DETAILED DESCRIPTION OF A PREFERRED EMBODIMENT

FIG. 1 shows an ink jet printer 10 having a media transport mechanism 12 over which an ink jet pen 14 reciprocates along a scan axis 16. The transport mechanism includes a platen assembly 20 having a flat upper surface. A vacuum blower 22 is connected to the platen device to draw air into the upper surface of the platen as will be discussed below. The blower is preferably a centrifugal blower capable of generating an 8–10 inch water vacuum. A media transport belt 24 encompasses the platen, and is tautly supported by opposed belt rollers 26, 30, one at an inlet edge 32 of the platen, and one at an outlet edge 34 of the platen. The uppermost surfaces of the rollers occupy a common plane with the upper surface of the platen assembly, so that the upper web of the belt rests at the platen's upper surface.

The belt is an air-transmissive mesh screen, or may be any perforated or porous sheet having a low air flow resistance, small thickness, and flexibility. The outlet end roller 30 is motorized to drive the belt in a feed direction 36, which defines the feed axis perpendicular to the scan axis 16. The movement of the belt is controlled by control circuitry (not shown) that also controls the pen scanning, ink droplet expulsion, and all other operations of the printer to provide coordinated action. A pair of paper guides 40 at the inlet end of the media transport adjust in concert to the width of a media sheet 42, centering the sheet on a midline of the platen parallel to the feed axis, and preventing skewing of the sheet. The guides may include sensors that feed back the guide positions to the controller so that the controller may establish other printer functions based on the inferred media width. An airflow shutter mechanism 43 operates in conjunction with the platen, as will be discussed below.

Figure 2:
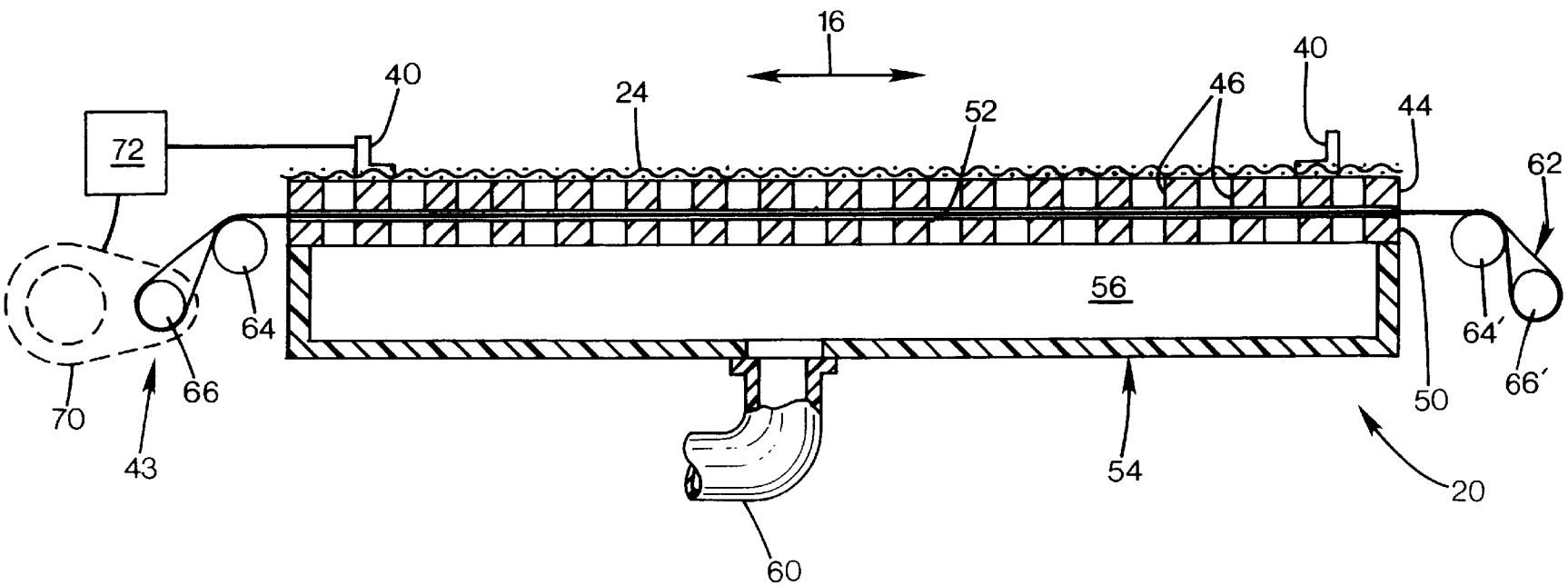
FIG. 2 is an enlarged sectional end view of a platen taken along line 2—2 of FIG. 1.

FIG. 2 shows an enlarged sectional view of the platen assembly 20. A rigid heater upper plate 44 provides structure for the platen surface, and is perforated with a multitude of holes or apertures 46. A lower plate 50 is spaced below the upper plate by a small gap 52 less than 1 mm wide. The lower plate includes perforations of the same size and locations as the upper plate, and the gap extends laterally through the plate. The gap is maintained by solid connections at the ends of the plates at the inlet end 32 and outlet end 34 of the platen.

The thickness if each plate is preferably about 12 mm, the hole diameter about 3 mm, and the hole center-to-center spacing about 6 mm, although these may vary widely in different applications. The apertures have a limited diameter, so that a pressure drop is generated during air flow, whereby the plenum can equalize any pressure differences readily even when some apertures are closed, as discussed below.

The apertures are sized in conjunction with the capacity of the blower to generate a pressure differential of at least 0.3 psi or 8 inches of water between the plenum and ambient to ensure the media sheet is secured adequately against the platen.

The upper plate has a heater element network (not shown) in the form of resistive traces on the surface of the plate, which generate an output of 0.15 $mW/mm^2$. Alternative heating methods may be employed. Below the heater plate is a box 54 that defines a plenum 56 having a height substantially greater that the heater plate hole diameters, so that the pressure in the plenum is substantially uniform. A blower conduit 60 communicates with blower 22.

The airflow shutter mechanism 43 includes a flexible continuous belt 62 that passes through the gap 52, and has a width filling the gap to extend the length of the platen. The belt is doubled onto itself so that two layers pass through the gap, and so that a loop extends from each side of platen. A first pair of elongated roller 64, 64' is positioned one on each side of the platen, extending the length of the platen, and at a level with the upper most periphery of each roller tangent to a plane defined by the upper surface of the lower plate 50. A similar second roller pair 66, 66' is positioned with each roller adjacent to a corresponding first roller, positioned downward and outboard of the first roller.

The belt loops about each second roller, with both webs passing above the first rollers. The belt is held adequately taut so that rotation of one roller overcomes frictional forces, and moves the belt. Motivation is provided by a motor 70 engaged to one of the rollers 66, and operably connected to a control circuit 72. The control circuit includes an input from a transducer associated with the media guides 40, so that the width of media to be transported may be inferred, and the belt set to a position as discussed below. In a simplified alternative embodiment, the paper guides may be mechanically linked to the top position, to achieve the same function discussed below.

Figure 3A:
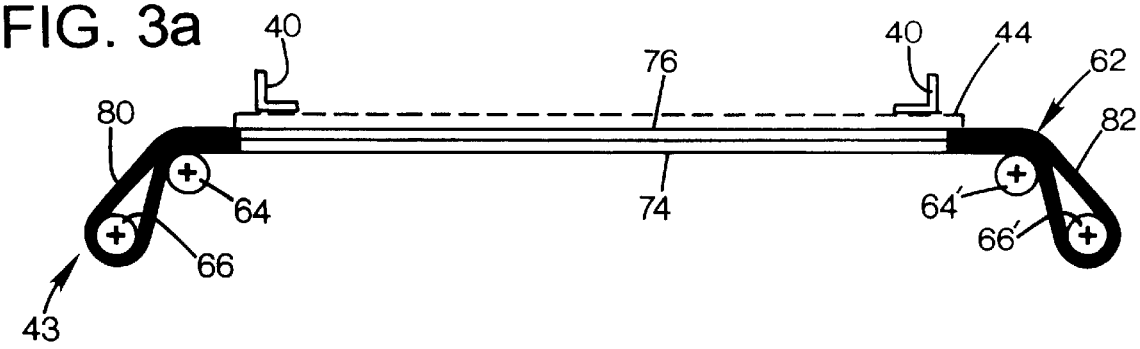

As shown in FIG. 3*a*, the belt 62 includes four sections, two air transmitting sections 74, 76, shown overlaying each other and registered with the plate 44, and two air-blocking portions 80, 82, each between and separated by the air-transmitting sections in an alternating manner. The air blocking sections are positioned away from the platen, and are wrapped about the rollers. Each air-transmitting section has a length at least as great as the platen width, so that the entire platen is over laid by each air-blocking section. The belt may be formed of any flexible material having a mesh, woven, or non-woven, or other air transmissive material such as a perforated sheet. The air-transmissive portions are left open, and the air blocking portions are either coated suitably, or are left unperforated. Preferably, the material is Kapton, and has relatively low friction to facilitate sliding. Alternative materials include other plastic films or flexible thin metal sheets with suitable perforations.

FIG. 3*a* shows a condition in which the entire platen is free to transmit air, so that a vacuum may be generated to secure to the feed belt 24 and platen a media sheet having a maximum width covering the platen. The guides 40 are positioned in the maximum width, and the ends of the air-blocking sections are at least at widely spaced apart as the guides. The entire platen is free to transmit air, so that a vacuum may be generated to secure to the feed belt 24 and platen a media sheet having a maximum width covering the platen. The guides 40 are positioned in the maximum width, and the ends of the air-blocking sections are at least as widely spaced apart as the guides.

Figure 3B:
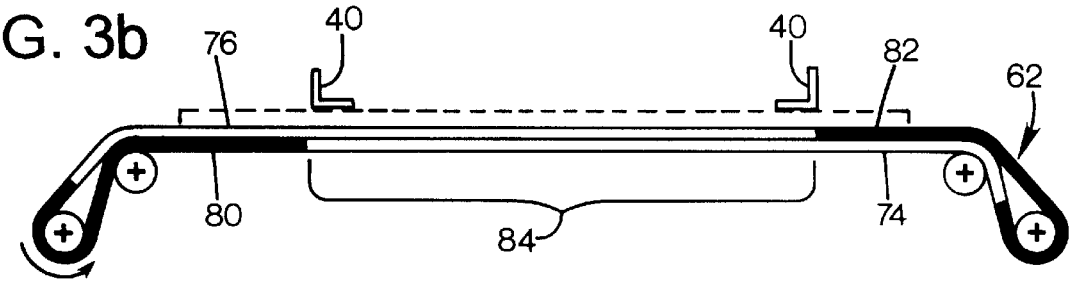
Figure 3C:
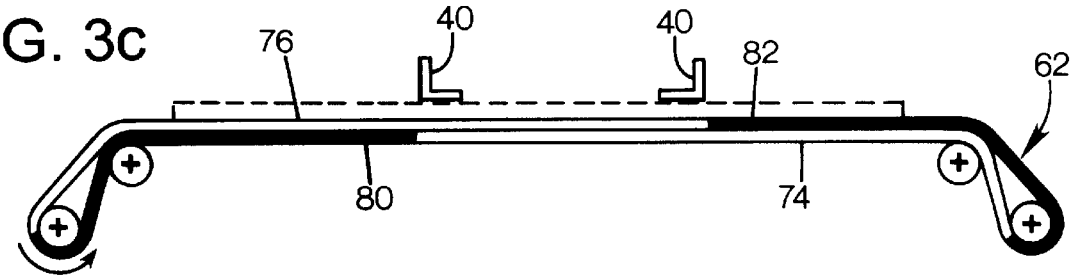

FIG. 3*b* shows a condition in which the guides are moved inward slightly to closely accommodate a narrower media sheet, keeping it centered on the platen. The belt 62 has been moved by turning the drive roller to advance the leading edges of the air blocking portions toward the mid line of the platen. The leading edges are spaced apart by a span 84 at least as wide as the media width accommodated by the guides, preferably slightly greater to provide a margin for error. Airflow through the platen is limited to the width of the span. FIG. 3*c* shows the guides in a narrower spacing, such as for a minimum width card or envelope media. However, there is no inherent limit to the narrowness of the media that may be used.

Figure 3D:
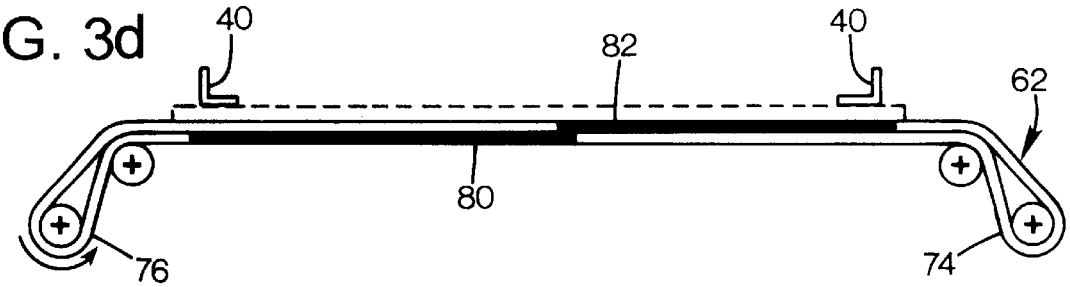

FIG. 3*d* shows a condition that may be used if it is desired to shut off airflow to the entire platen. For this, the air-blocking portions must each have a length equal to half the width of the platen, to ensure full coverage of the platen. For embodiments where full shutoff capability is not required, and where a larger minimum media width is tolerated, the air blocking portions need only have lengths each equal to half the difference between the minimum and maximum media widths.

The fully blocking configuration principles may also be employed in an alternative embodiment in which several independently controlled and narrower airflow control belts are employed, each arranged edge to edge, as if a full-width belt were severed circumferentially into narrower belts. This would permit complete shut off of the platen portion prior to the arrival of the leading edge of the media sheet, and of portions subsequent to the passage of the sheet's trailing edge. The sections over which a sheet is passing would be set to a width commensurate with the media width, as discussed above.

By maintaining an open air flow region underneath all portions of the media sheet, the entire sheet is flattened against the platen. Some marginal open areas beyond the sheet edges on all sides are tolerated, with the blower having adequate capacity to maintain the needed plenum partial vacuum even when these areas are open. With a blower rated at 10 inches of water at 50 cubic feet per minute, an open area of about 40–50% of the platen area is tolerated while maintaining the needed pressure differential. This is significantly less than the typical area of the entire platen, necessitating the closing of many or most of the valves where the platen is not covered by the media sheet to allow the practical and economical use of a limited capacity blower, with attendant advantages in size, power consumption, and quietness.

While the above is discussed in terms of preferred and alternative embodiments, the invention is not intended to be so limited. For instance, in another alternative embodiment, two or more air flow control belts may be used, with a width control belt as shown, and a length control belt operating at a right angle, with motion in the feed direction. This would allow the platen to remain closed in advance of the leading edge of the media sheet, and to close following the trailing edge. Such a belt may have only one web passing through the plate gap (or above the plate), so that an air-transmissive portion having the full length of the platen can be positioned for air flow, and an air blocking section at least that long may be provided to allow full platen coverage, or a selective coverage amount from either end.

What is claimed is:

1. A printer with a media transport comprising:

a rigid, air-transmissive platen;

a movable air-transmissive flexible first web overlaying the platen;

a suction device in communication with the platen to draw air through the web and through the platen such that a sheet of media carried on the web is biased toward the platen; and a second movable web adjacent to the platen to limit air flow through at least a selected portion of the platen other than a portion overlain by the sheet.

2. The printer of claim 1 wherein the second web includes an air-transmissive portion and an air blocking portion.

3. The printer of claim 2 wherein the air blocking portion is movable to obscure a peripheral edge portion of the platen of a selectable width.

4. The printer of claim 1 wherein the first web is movable along a feed axis over the platen, and the second web is movable along a perpendicular second axis over the platen.

5. The printer of claim 1 wherein the second web is a continuous belt having two layers registered with the platen, and end loop portions beyond opposed edge portions of the platen.

6. The printer of claim 5 wherein the belt has two air-transmissive portions and two air blocking portions in alternating arrangement, and wherein the belt is movable through a range of positions from a fully open position in which the air transmissive portions are registered with the entire platen, and at least an intermediate position in which a first one of the air blocking portions is registered with a first edge portion of the platen, and a second one of the air blocking portions is registered with an opposed edge portion of the platen.

7. The printer of claim 1 wherein the web is a continuous belt having two air-transmissive portions and two air blocking portions in alternating arrangement, and wherein the belt is movable through a range of positions from a fully open position in which the air transmissive portions is registered with the entire platen, and at least an intermediate position in which a first one of the air blocking portions is registered with a first edge portion of the platen, and a second one of the air blocking portions is registered with an opposed edge portion of the platen.

8. The printer of claim 1 wherein the second web is operable to establish a width of the platen through which air may flow.

9. A media transport for a printer comprising:

a rigid, air-transmissive platen;

an air-transmissive flexible web overlaying the platen and movable along a feed axis to carry a media sheet over the platen along the feed axis;

a suction device in communication with the platen to draw air through the web and through the platen; and a shutter element operable to prevent air transmissions through a lateral edge portion of the platen.

10. The transport of claim 9 wherein the shutter is adjustable through a range of positions from a fully open position in which the air is transmitted through the entire platen, and at least an intermediate position in which the lateral edge portion is obscured.

11. The transport of claim 9 including a pair of opposed shutter elements operable to symmetrically obscure opposed lateral edge portions of the platen.

12. The transport of claim 11 wherein the opposed shutter elements are interlinked to operate in concert, such that a gap defined between a leading edge of each shutter element is centered medially on the platen.

13. The transport of claim 9 wherein the shutter is movable along a shutter axis perpendicular to the feed axis and parallel to the platen.

14. The transport of claim 9 wherein the shutter is an air blocking portion of a web having an air transmissive portion at least partly registered with the platen.

15. The transport of claim 14 wherein the shutter is a continuous flexible belt having two layers registered with the platen, and end loop portions beyond the lateral edge portions of the platen.

16. The transport of claim 15 wherein the belt has two air-transmissive portions and two air blocking portions in alternating arrangement.

17. The transport of claim 16 wherein the belt is movable through a range of positions from a fully open position in which both air transmissive portions are registered with the entire platen, and at least an intermediate position in which a first one of the air blocking portions is registered with a first edge portion of the platen, and a second one of the air blocking portions is registered with an opposed edge portion of the platen.

18. The transport of claim 9 wherein the shutter is operable to establish a width of the platen through which air may flow.

19. A method of operating a printer media transport having a rigid, air-transmissive platen with an overlaying air-transmissive flexible web movable along a feed axis to carry a media sheet over the platen along the feed axis comprising:

drawing air through the web and through the platen;

providing a shutter element operable to prevent air transmissions through a lateral edge portion of the platen;

moving the shutter to establish a width of the platen through which air may flow; and after establishing a width, moving the web to feed a media sheet.

20. The method of claim 19 including determine a media width, and moving the shutter to a position to a position that obscures at least some of the platen to provide an active platen portion through which air flows, and wherein the active platen portion has a width is at least as great as the media width, and less than the platen width.

* * * * *